US010377975B2

(12) United States Patent
Miracle et al.

(10) Patent No.: US 10,377,975 B2
(45) Date of Patent: Aug. 13, 2019

(54) PACKAGED COMPOSITION

(71) Applicant: The Procter & Gamble Company, Cincinnati, OH (US)

(72) Inventors: Gregory Scot Miracle, Liberty Township, OH (US); Daniel Dale Ditullio, Jr., Hamilton, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 226 days.

(21) Appl. No.: 15/298,260

(22) Filed: Oct. 20, 2016

(65) Prior Publication Data

US 2017/0114304 A1 Apr. 27, 2017

Related U.S. Application Data

(60) Provisional application No. 62/245,456, filed on Oct. 23, 2015.

(51) Int. Cl.

| | |
|---|---|
| ***C11D 3/40*** | (2006.01) |
| ***B65D 85/00*** | (2006.01) |
| ***C11D 3/37*** | (2006.01) |
| ***C11D 3/43*** | (2006.01) |
| ***C11D 3/50*** | (2006.01) |
| ***C11D 17/06*** | (2006.01) |
| ***C11D 17/04*** | (2006.01) |

(52) U.S. Cl.

CPC ..... *C11D 3/40* (2013.01); *B65D 85/70* (2013.01); *C11D 3/3707* (2013.01); *C11D 3/43* (2013.01); *C11D 3/505* (2013.01); *C11D 17/041* (2013.01); *C11D 17/06* (2013.01)

(58) Field of Classification Search

CPC ..... C11D 3/40; B65D 85/00

See application file for complete search history.

(56) References Cited

U.S. PATENT DOCUMENTS

| | | | | |
|---|---|---|---|---|
| 5,040,313 | A * | 8/1991 | Simjian | A43B 3/00 36/114 |
| 8,183,197 | B2 | 5/2012 | Prabhat et al. | |
| 10,000,727 | B2 * | 6/2018 | Sodd | C11D 3/50 |
| 2010/0069282 | A1 * | 3/2010 | Prabhat | C11D 3/40 510/276 |
| 2016/0122693 | A1 * | 5/2016 | Sodd | C11D 3/50 512/4 |
| 2016/0369211 | A1 * | 12/2016 | Dykstra | C11B 9/00 |

FOREIGN PATENT DOCUMENTS

| | | | | |
|---|---|---|---|---|
| WO | WO-2009047126 | A2 * | 4/2009 | C11D 3/3753 |
| WO | WO-2009047127 | A1 * | 4/2009 | C11D 1/83 |
| WO | WO 2011/020991 | A1 | 2/2011 | |
| WO | WO-2011020991 | A1 * | 2/2011 | C11D 3/10 |
| WO | WO-2016073400 | A1 * | 5/2016 | C11D 3/50 |
| WO | WO-2016205587 | A1 * | 12/2016 | C11B 9/00 |

OTHER PUBLICATIONS

International Search Report; International Application No. PCT/US2016/057783; dated Jan. 30, 2017; 14 pages.

* cited by examiner

*Primary Examiner* — Nicole M. Buie-Hatcher
*Assistant Examiner* — M. Reza Asdjodi
(74) *Attorney, Agent, or Firm* — Gary J. Foose

(57) ABSTRACT

A packaged particulate composition having a carrier and a shading dye.

14 Claims, 5 Drawing Sheets

PACKAGED COMPOSITION

FIELD OF THE INVENTION

Packaged composition.

BACKGROUND OF THE INVENTION

As textile substrates age, their color tends to fade or yellow due to exposure to light, air, soil, and natural degradation of the fibers that comprise the substrates. Thus, the purpose of shading dyes is generally to visually whiten these textile substrates and counteract the fading and yellowing of the substrates. Typically, shading dyes may be found in laundry detergents and are therefore applied to textile substrates during the laundering process. However, the color of the shading dyes typically dominates the overall appearance of the composition in which it resides. Further, it is also known that shading dyes may interact negatively with certain adjunct material in the composition in which it resides. Moreover when the shading dye is in a laundry detergent, the consumer does not have the flexibility to customize their desired experience. Extra whitening can be achieved only by adding additional detergent, which necessitates increased and potentially wasteful levels of cleaning ingredients and may also result in deposition of too much fragrance. Thus the consumer cannot balance their desire for efficient usage of cleaning ingredients, adjusting for the right amount of scent, and yet also be able to deliver variable amounts of whitening according to the needs of the particular fabrics being treated.

As a result, there exists a need for a packaged composition that includes a shading dye that may be used independently as an additive to satisfy the consumer desire for adjustable dose, on demand whitening or may be incorporated into a laundry detergent, but also provides ease of use and flexibility in the laundry detergents' appearance and components.

It has surprisingly been found that the packaged compositions of the present disclosure which incorporate the shading dyes are not only effective in the whitening of textile substrates, but also provide a clean and convenient means to add the desired amount of a whitening agent to a laundry treatment without resulting in staining of fabrics that can occur on direct contact of detergents that contain shading agents.

SUMMARY OF THE INVENTION

A packaged composition comprising a plurality of particles, wherein at least one of the particles comprise: a carrier; and at least 30% of the particles also comprise a shading dye; wherein at least 80% of the particles have a density less than about 1.25 g/cm$^3$; wherein at least 80% of the particles have a mass between about 0.1 mg to about 5 g; and wherein each of the particles has a maximum dimension of less than about 10 mm.

A process for treating laundry comprising the steps of dosing to a laundry washing machine or a laundry wash basin per 3 kg of fabric being laundered, from about 0.1 g to about 200 g, or from about 0.5 g to about 100 g, or from about 2.0 g to about 60 g, or from about 5 g to about 25 g of particles, the particles comprising: a carrier; and shading dye; and wherein at least 80% of the particles have a density less than about 1.25 g/cm$^3$; wherein at least 80% of the particles have a mass between about 0.1 mg to about 5 g; and wherein substantially all of the particles have a maximum dimension of less than about 10 mm; said dosing providing an aqueous solution comprising shading dye from 1 ppb to 5000 ppm, preferably 10 ppb to 50 ppm, even more preferably 25 ppb to 2 ppm or even 50 ppb to 1 ppm; and optionally rinsing and drying the textile.

DETAILED DESCRIPTION OF THE INVENTION

Particles

Figure 1:
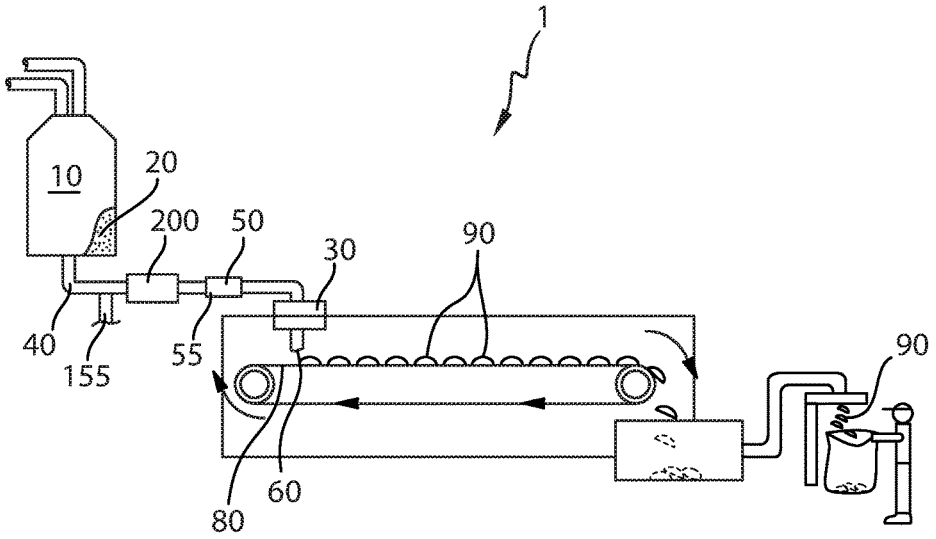
FIG. 1 is an apparatus for forming particles.

An apparatus 1 for forming particles is shown in FIG. 1. The raw material or raw materials can be provided to a batch mixer 10. The batch mixer 10 can have sufficient capacity to retain the volume of raw materials provided thereto for a sufficient residence time to permit the desired level of mixing and or reaction of the raw materials. The material leaving the batch mixer 10 can be the precursor material 20. Optionally, the precursor material can be provided to the feed pipe 40 from some other upstream mixing process, for example in-line mixing, in-line static mixing, and the like. The precursor material 20 can be a molten product. The batch mixer 10 can be a dynamic mixer. A dynamic mixer is a mixer to which energy is applied to mix the contents in the mixer. The batch mixer 10 can comprise one or more impellers to mix the contents in the batch mixer 10.

Between the batch mixer 10, which is optionally present, and the distributor 30, the precursor material 20 can be transported through the feed pipe 40. The feed pipe 40 can be in fluid communication with the batch mixer 10. A gas feed line 155 can be provided in fluid communication with the feed pipe 40 downstream of the batch mixer 10. A gas feed line 155 can be provided in fluid communication with the feed pipe 40 between the batch mixer 10 and the distributor 30. A mill 200 can be provided downstream of the gas feed line 155 and in line with the feed pipe 40. The mill 200 can be provided in line with the feed pipe 40 downstream of the gas feed line 155 and upstream of the distributor 30.

The precursor material 20 can be provided to the feed pipe 40. The feed pipe 40 is the conveyance by which the precursor material 20 is carried. The feed pipe 40 includes the conveyance between elements of the apparatus 1 and the conveyance through which the precursor material is carried within components of the apparatus 1. For instance, the mill 200 may be provided in a unit with a portion of the conveyance approaching the mill 200 and a portion of the conveyance exiting the mill 200. Each of these portions is part of the feed pipe 40. So, the feed pipe 40 can be viewed the entire conveyance between the batch mixer 10 and the distributor 30 and the feed pipe 40 is interrupted by various elements such as the gas feed line 155, the mill 200, intermediate mixer 50, and feed pump 140. In absence of a batch mixer 10 upstream of the feed pipe 40, the feed pipe 40 can be viewed the entire conveyance upstream of the distributor 30 and the feed pipe 40 is interrupted by various elements such as the gas feed line 155, the mill 200, intermediate mixer 50, and feed pump 140.

An intermediate mixer 55 can be provided downstream of the mill 200 and in line with feed pipe 40. The intermediate mixer 55 can be in fluid communication with the feed pipe 40 between the mill 200 and the distributor 30. The intermediate mixer 55, which can be a static mixer 50, can be downstream of the batch mixer 10. Stated otherwise, the batch mixer 10 can be upstream of the intermediate mixer 55 or static mixer 50 if employed. The intermediate mixer 55 can be in-line with the feed pipe 40. The intermediate mixer 55 can be a rotor-stator mixer. The intermediate mixer 55 can be a colloid mill. The intermediate mixer 55 can be a driven in-line fluid disperser. The intermediate mixer 55 can be an Ultra Turrax disperser, Dispax-reactor disperser, Colloid Mil MK, or Cone Mill MKO, available from IKA, Wilmington, N.C., United States of America. The intermediate mixer 55 can be a perforated disc mill, toothed colloid mill, or DIL Inline Homogenizer, available from FrymaKoruma, Rheinfelden, Switzerland. The static mixer 50 can be a helical static mixer. The static mixer 50 can be a Kenics 1.905 cm inside diameter KMS 6, available from Chemineer, Dayton, Ohio, USA.

Without being bound by theory, it is believed that an intermediate mixer 55, such as the static mixer 50, can provide for a more uniform temperature of the precursor material 20 within the distributor 30 or stator 100. At the downstream end of the intermediate mixer 55, or static mixer 50 if used, the temperature of the precursor material 20 within the feed pipe 40 across a cross section of the feed pipe 40 can vary by less than about 10° C., or less than about 5° C., or less than about 1° C., or less than about 0.5° C.

In absence of a static mixer 50, the temperature across a cross section of the feed pipe 40 may be non-uniform. The temperature of the precursor material 20 at the center line of the feed pipe 40 may be higher than the temperature of the precursor feed material 20 at the peripheral wall of the feed pipe 40. When the precursor material 20 is discharged to the distributor 30 or stator 100, the temperature of the precursor material 20 may vary at different positions within the distributor or stator 100. Without being bound by theory, it is thought that by providing for a uniform temperature across the cross section of the feed pipe 40 by employing a static mixer 40 as described herein, more uniform particles 90 can be produced as compared to an apparatus 1 that does not have a static mixer 40.

The distributor 30 can be provided with a plurality of apertures 60. The precursor material 20 can be passed through the apertures 60. After passing through the apertures 60, the precursor material 20 can be deposited on a moving conveyor 80 that is provided beneath the distributor 30. The precursor material 20 can be deposited on the moving conveyor 80 when the conveyor 80 is in motion. The conveyor 80 can be moveable in translation relative to the distributor 30. The conveyor 80 can be a continuously moving conveyor 80. The conveyor 80 can be an intermittently moving conveyor 80. A continuously moving conveyor 80 may provide for higher processing speeds. An intermittently moving conveyor 80 can provide for improved control of the shape of the particles 90 that are produced.

The precursor material 20 can be cooled on the moving conveyor 80 to form a plurality of solid particles 90. The cooling can be provided by ambient cooling. Optionally the cooling can be provided by spraying the under-side of the conveyor 80 with ambient temperature water or chilled water.

Once the particles 90 are sufficiently coherent, the particles 90 can be transferred from the conveyor 80 to processing equipment downstream of the conveyor 80 for further processing and or packaging.

Figure 2:
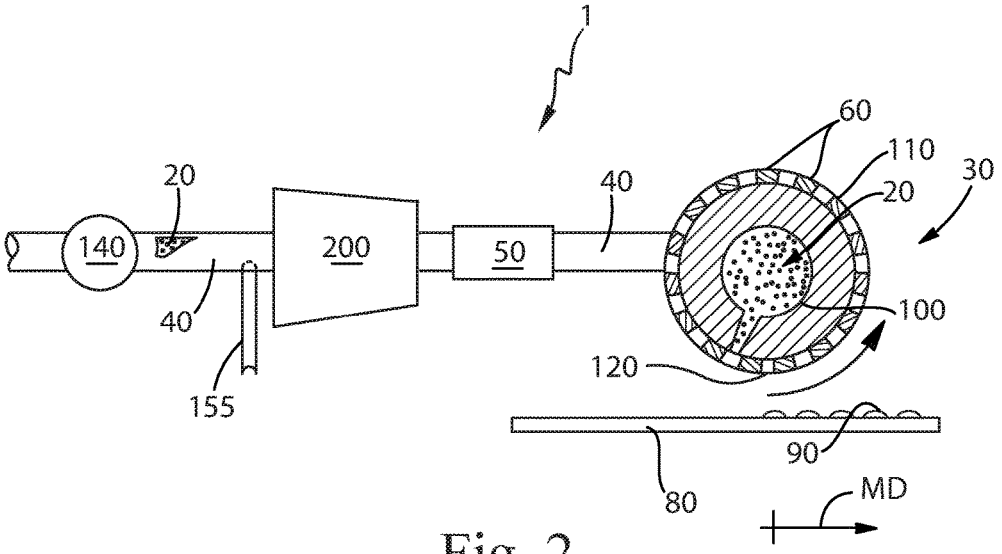
FIG. 2 is a portion of an apparatus.

The distributor 30 can be a cylinder 110 rotationally mounted about a stator 100 with the stator being in fluid communication with the feed pipe 40 and the cylinder 110 can have a periphery 120 and there can be a plurality of apertures 60 in the periphery 120, as shown in FIG. 2. So, the apparatus 1 can comprise a stator 100 in fluid communication with the feed pipe 40. The feed pipe 40 can feed the precursor material 20 to the stator 100 after the precursor material 20 has passed through the mill 200.

The apparatus 1 can comprise a cylinder 110 rotationally mounted about the stator 100. The stator 100 is fed precursor material through one or both ends 130 of the cylinder 110. The cylinder 110 can have a longitudinal axis L passing through the cylinder 110 about which the cylinder 110 rotates. The cylinder 110 has a periphery 120. There can be a plurality of apertures 60 in the periphery 120 of the cylinder 110.

As the cylinder 110 is driven to rotate about its longitudinal axis L, the apertures 60 can be intermittently in fluid communication with the stator 100 as the cylinder 110 rotates about the stator 100. The cylinder 110 can be considered to have a machine direction MD in a direction of movement of the periphery 120 across the stator 100 and a cross machine direction on the periphery 120 orthogonal to the machine direction MD. The stator 100 can similarly be considered to have a cross machine direction CD parallel to the longitudinal axis L. The cross machine direction of the stator 100 can be aligned with the cross machine direction of the cylinder 110. The stator 100 can have a plurality of distribution ports 120 arranged in a cross machine direction CD of the stator 100. The distribution ports 120 are portions or zones of the stator 100 supplied with precursor material 20.

In general, precursor material 20 can be fed past the gas feed line 155 through the mill 200 and feed pipe 40 to the stator 100. The stator 100 distributes the precursor feed material 20 across the operating width of the cylinder 110. As the cylinder 110 rotates about its longitudinal axis, precursor material 20 is fed through the apertures 60 as the apertures 60 pass by the stator 100. A discrete mass of precursor material 20 is fed through each aperture 60 as each aperture 60 encounters the stator 100. The mass of precursor material 20 fed through each aperture 60 as each aperture 60 passes by the stator 100 can be controlled by controlling one or both of the pressure of the precursor material within the stator 100 and the rotational velocity of the cylinder 110.

Drops of the precursor material 20 are deposited on the conveyor 80 across the operating width of the cylinder 110. The conveyor 80 can be moveable in translation relative to the longitudinal axis of the cylinder 110. The velocity of the conveyor 80 can be set relative to the tangential velocity of the cylinder 110 to control the shape that the precursor material 20 has once it is deposited on the conveyor 80. The velocity of the conveyor 80 can be the about the same as the tangential velocity of the cylinder 110.

As shown in FIG. 1, flow of the precursor material 20 through the feed pipe 40 can be provided by gravity driven flow from a batch mixer 10 and the distributor 30. To provide for more controllable manufacturing, the apparatus 1 can be provided with a feed pump 140, as shown in FIG. 2. The feed pump 140 can be in line with the feed pipe 40, with in line meaning in the line of flow of the precursor material 20. The feed pump 140 can between the batch mixer 10 and the distributor 30. The feed pump 140 can be upstream of the distributor 30. If a stator 100 is employed, the feed pump 140 can be in line with the feed pipe 40, with in line meaning in the line of flow of the precursor material 20. If a stator 100 is employed, the feed pump 140 can be between the batch mixer 10 and the stator 100. The feed pump 140 can be upstream of the stator 100. In describing the position of the feed pump 140, between is used to describe the feed pump 140 being in-line downstream of the batch mixer 10 and upstream of the distributor 30 or if used, upstream of the stator 100.

The gas feed line 155 and the mill 200 can be positioned in line between the feed pump 140 and the distributor 30 or stator 100, if employed in the apparatus 1.

The gas feed line 155 can comprise a flow regulator 158. The flow regulator 158 can regulate the flow of gas into the feed line 40. The volume of gas added per unit volume of precursor material 20 can be controlled by setting the flow regulator 158 to the desired flow. The more gas fed into the precursor material 20 within the feed line 40, the more gas that will be contained in the particles 90. The gas feed line 155 can provide for entraining gas into the precursor material 20.

The flow regulator 158 can be Key Instruments Flo-Rite Series GS 65 mm flowmeter, part number 60410-R5. The feed line 40 can be a 1½" stainless steel sanitary pipe. The gas feed line 155 can be ¼" inside diameter polyethylene tubing. Gas can be provided in the gas feed line 155 at a pressure of about 85 psi.

The flow rate of the precursor material 20 can be about 3 L/min. The precursor material 20 can be a molten material comprising any of the compositions described herein for the precursor material 20 or particles 90.

The gas provided in the gas feed line 155 can be air. Air can be practical in that it is readily available, low cost, and the chemical interactions with constituents of the particles 90 are well understood.

The gas provided in the gas feed line 155 can be an inert gas. An inert gas can be practical in that particles 90 entrained with an inert gas may be less susceptible to degradation as compared to particles 90 entrained with air.

The gas provided in the gas feed line 155 can be selected from the group consisting of air, oxygen, nitrogen, carbon dioxide, argon, and mixtures thereof. Such gasses are widely available and commonly used in commercial applications. Without being bound by theory, such gasses might improve the stability of the product.

The gas can be provided at a temperature such that when the gas reaches ambient temperature the desired volume of gas is present in the particles 90. The Ideal Gas Law can be used to determine the desired temperature of delivery. The gas can also comprise water. The water can be in gaseous or liquid form. The quantity of water in the gas can be selected to be at the desired level.

Optionally gas can be entrained in the precursor material by mixing a gas generating material in the precursor material 20.

The mill 200 can be a rotor-stator type mill. The mill can be a Quadro Z1 in-line mixer with a single stage of medium rotor stators, operated at about 400 RPM.

The mill 200 and gas feed line 155 can be combined in a single unit.

An Oakes Foamer (E.T. Oakes Corporation, 686 Old Willets Path, Hauppauge, N.Y. 11788) 2MT1A continuous foamer) can be used to provide the gas feed line 155, flow regulator 158 and mill 200 in a single unit.

Figure 3:
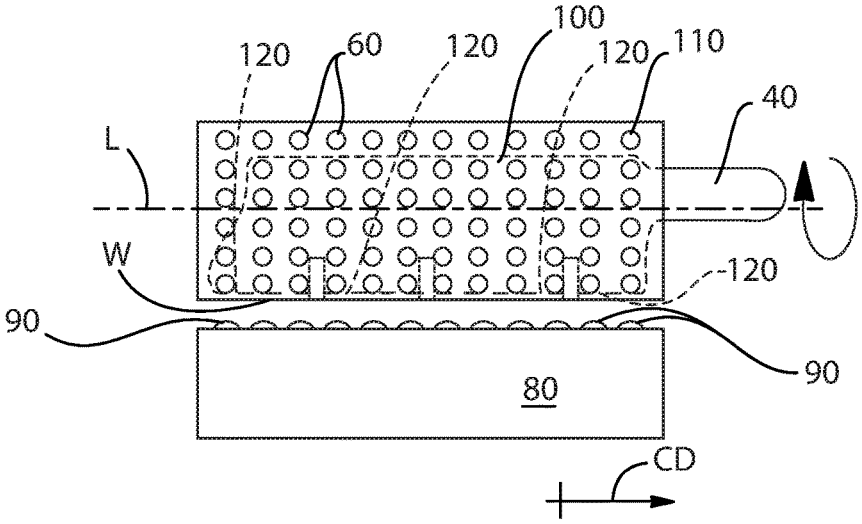
FIG. 3 is an end view an apparatus.

A view of an apparatus 1 in the machine direction MD is shown in FIG. 3. As shown in FIG. 3, the apparatus 1 can have an operating width W and the cylinder 110 can rotate about longitudinal axis L.

The apparatus 1 for forming particles 90 can comprise: a feed pipe; a gas feed line 155 mounted in fluid communication with the feed pipe 40 downstream of the batch mixer 10; a mill 200 downstream of the gas feed line 155 and in line with the feed pipe 40; and a distributor 30 downstream of the mill 200 and fluid communication with said feed pipe 40, wherein said distributor 30 comprises a plurality of apertures 60. The apparatus 1 can comprise a conveyor beneath the distributor 30 and movable in translation relative to the distributor 30. The distributor 30 can comprise a stator 100 in fluid communication with the feed pipe 40. The distributor 30 can comprise a cylinder 110 rotationally mounted about the stator 100 and rotatable about a longitudinal axis L of the cylinder 110. The cylinder 110 can have a periphery 120 and the cylinder 110 can have a plurality of apertures 60 disposed about the periphery 120. The apertures 60 can be intermittently in fluid communication with the stator 100 as the cylinder 110 rotates about the stator 100. The apparatus can comprise a conveyor 80 beneath the cylinder 110 and the conveyor 80 can be movable in translation relative to the longitudinal axis L. The apparatus 1 for forming particles 90 can comprise a batch mixer 10. The feed pipe 40 can be in fluid communication with the batch mixer 10.

The process for forming particles 90 can comprise the steps of: providing a precursor material 20 to a feed pipe 40; providing the precursor material 20 to the feed pipe 40; entraining gas into the precursor material 20, providing a stator 100 in fluid communication with the feed pipe 40; distributing the precursor material 20 to the stator 100; providing a cylinder 110 rotating about the stator 100 and rotatable about a longitudinal axis L of the cylinder 110, wherein the cylinder 110 has a periphery 120 and a plurality of apertures 60 disposed about the periphery 120; passing the precursor material 120 through the apertures 60; providing a moving conveyor 80 beneath the cylinder 110; depositing the precursor material 20 onto the moving conveyor 80; and cooling the precursor material 20 to form a plurality of particles 90. The process can be implemented using any of the apparatuses disclosed herein. The process can employ any of the precursor materials 20 disclosed herein to form any of the particles 90 disclosed herein. The process can comprise the step of providing a precursor material 20 in a batch mixer 10 in fluid communication with the feed pipe.

The process for forming particles 90 can comprise the steps of: providing a precursor material 20 to a feed pipe 40; providing the precursor material 20 to the feed pipe 40; entraining gas into the precursor material 20; providing a distributor 30 having a plurality of apertures 60; transporting the precursor material 20 from the feed pipe 40 to the distributor 30; passing the precursor material 20 through the apertures 60; providing a moving conveyor 80 beneath the distributor 30; depositing the precursor material 20 on to the moving conveyor 80; and cooling the precursor material 20 to form a plurality of particles 90. The precursor material 20 can comprises more than about 40% by weight polyethylene glycol having a weight average molecular weight from about 2000 to about 13000 and from about 0.0001% to about 50% by weight shading dye, or, preferably, from 0.001% to about 25% by weight shading dye as disclosed herein. The process can be implemented using any of the apparatuses disclosed herein. The process can employ any of the additional precursor materials 20 disclosed herein to form any of the particles 90 disclosed herein. The process can comprise the step of providing a precursor material 20 in a batch mixer 10 in fluid communication with the feed pipe.

The precursor material 20 can be any composition that can be processed as a molten material that can be formed into the particles 90 using the apparatus 1 and method described herein. The composition of the precursor material 20 is governed by what benefits will be provided with the particles 90. The precursor material 20 can be a raw material composition, industrial composition, consumer composition, or any other composition that can advantageously be provided in a particulate form.

The precursor material 20 and particles 90 can be incorporated into a fabric detergent composition, as known in the art. When incorporated into a fabric detergent, the fabric detergent may also include from about 0.001% to less than about 90% typical fabric care adjuncts, as known in the art, including surfactants, builders, chelating agents, dye transfer inhibiting agents, dispersants, enzymes, and enzyme stabilizers, plasticizing solvents, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments and mixtures thereof. When the precursor material 20 and particles 90 are not incorporated into a fabric detergent composition, any typical fabric care adjuncts, as known in the art, may be co-incorporated along with the shading dye into the precursor material 20 and particles 90 according to the desired benefits to be delivered. For example, in order to protect the dye from degradation, anti-oxidants, UV absorbing compounds and the like may be co-incorporated. Moreover, for aesthetic purposes, other dyes may be incorporated both in particles that comprise shading dye and in particles that do not comprise shading dye. Perfumes that may be incompatible can be incorporated in the packaged composition by placing those perfumes into particles that do not comprise shading dye, or only comprise very low levels. As will be understood by those skilled in the art, these are merely examples of the ways in which the ordinarily skilled artisan may construct the packaged composition in order to maximize the intended benefit and are not meant to be limiting.

The precursor material 20 and particles 90 can comprise a carrier and any combination of shading dye, aesthetic dye, perfume, and occlusions of gas. The occlusions of gas can be spherical occlusions of gas.

Carrier

The carrier can be or comprise a material selected from the group consisting of water soluble inorganic alkali metal salt, water-soluble alkaline earth metal salt, water-soluble organic alkali metal salt, water-soluble organic alkaline earth metal salt, water soluble carbohydrate, water-soluble silicate, water soluble urea, and any combination thereof. Alkali metal salts can be, for example, selected from the group consisting of salts of lithium, salts of sodium, and salts of potassium, and any combination thereof. Useful alkali metal salts can be, for example, selected from the group consisting of alkali metal fluorides, alkali metal chlorides, alkali metal bromides, alkali metal iodides, alkali metal sulfates, alkali metal bisulfates, alkali metal phosphates, alkali metal monohydrogen phosphates, alkali metal dihydrogen phosphates, alkali metal carbonates, alkali metal monohydrogen carbonates, alkali metal acetates, alkali metal citrates, alkali metal lactates, alkali metal pyruvates, alkali metal silicates, alkali metal ascorbates, and combinations thereof.

Alkali metal salts can be selected from the group consisting of, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium, ascorbate, and combinations thereof. Alkaline earth metal salts can be selected from the group consisting of salts of magnesium, salts of calcium, and the like, and combinations thereof. Alkaline earth metal salts can be selected from the group consisting of alkaline metal fluorides, alkaline metal chlorides, alkaline metal bromides, alkaline metal iodides, alkaline metal sulfates, alkaline metal bisulfates, alkaline metal phosphates, alkaline metal monohydrogen phosphates, alkaline metal dihydrogen phosphates, alkaline metal carbonates, alkaline metal monohydrogen carbonates, alkaline metal acetates, alkaline metal citrates, alkaline metal lactates, alkaline metal pyruvates, alkaline metal silicates, alkaline metal ascorbates, and combinations thereof. Alkaline earth metal salts can be selected from the group consisting of magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, and combinations thereof. Inorganic salts, such as inorganic alkali metal salts and inorganic alkaline earth metal salts, do not contain carbon. Organic salts, such as organic alkali metal salts and organic alkaline earth metal salts, contain carbon. The organic salt can be an alkali metal salt or an alkaline earth metal salt of sorbic acid (i.e., asorbate). Sorbates can be selected from the group consisting of sodium sorbate, potassium sorbate, magnesium sorbate, calcium sorbate, and combinations thereof.

The carrier can be or comprise a material selected from the group consisting of a water-soluble inorganic alkali metal salt, a water-soluble organic alkali metal salt, a water-soluble inorganic alkaline earth metal salt, a water-soluble organic alkaline earth metal salt, a water-soluble carbohydrate, a water-soluble silicate, a water-soluble urea, and combinations thereof. The carrier or water soluble-soluble carrier can be selected from the group consisting of sodium chloride, potassium chloride, calcium chloride, magnesium chloride, sodium sulfate, potassium sulfate, magnesium sulfate, sodium carbonate, potassium carbonate, sodium hydrogen carbonate, potassium hydrogen carbonate, sodium acetate, potassium acetate, sodium citrate, potassium citrate, sodium tartrate, potassium tartrate, potassium sodium tartrate, calcium lactate, water glass, sodium silicate, potassium silicate, dextrose, fructose, galactose, isoglucose, glucose, sucrose, raffinose, isomalt, xylitol, candy sugar, coarse sugar, and combinations thereof. In one embodiment, the carrier or water-soluble carrier can be sodium chloride. In one embodiment, the carrier or water-soluble carrier can be table salt.

The carrier can be or comprise a material selected from the group consisting of sodium bicarbonate, sodium sulfate, sodium carbonate, sodium formate, calcium formate, sodium chloride, sucrose, maltodextrin, corn syrup solids, corn starch, wheat starch, rice starch, potato starch, tapioca starch, clay, silicate, citric acid carboxymethyl cellulose, fatty acid, fatty alcohol, glyceryl diester of hydrogenated tallow, glycerol, and combinations thereof.

The carrier can be selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid carboxymethyl cellulose, fatty acid, fatty alcohol, glyceryl diester of hydrogenated tallow, glycerol, polyethylene glycol, polyvinyl alcohol and combinations thereof.

The particles 90 can comprise from about 20% by weight to about 99.9% by weight of the particles 90 of the carrier. The carrier can be polyethylene glycol.

The precursor material 20, and thereby the particles 90, can comprise more than about 20% by weight polyethylene glycol having a weight average molecular weight from about 2000 to about 13000. Polyethylene glycol (PEG) has a relatively low cost, may be formed into many different shapes and sizes, minimizes diffusion of small molecules such as some shading dyes or unencapsulated perfumes, and dissolves well in water. PEG comes in various weight average molecular weights. A suitable weight average molecular weight range of PEG includes from about 2,000 to about 13,000, from about 4,000 to about 12,000, alternatively from about 5,000 to about 11,000, alternatively from about 6,000 to about 10,000, alternatively from about 7,000 to about 9,000, alternatively combinations thereof. PEG is available from BASF, for example PLURIOL E 8000.

The precursor material 20, and thereby the particles 90, can comprise more than about 20% by weight of the particles of PEG. The precursor material 20, and thereby the particles 90, can comprise more than about 40% by weight of the particles of PEG. The precursor material 20, and thereby the particles 90, can comprise more than about 60% by weight of the particles of PEG. The precursor material 20, and thereby the particles 90, may comprise from about 65% to about 99.9% by weight of the composition of PEG. The precursor material 20, and thereby the particles 90, may comprise from about 20% to about 99.9% by weight of the composition of PEG.

Alternatively, the precursor material 20, and thereby the particles 90, can comprise from about 20% to less than about 99.9%, alternatively from about 45% to about 90%, alternatively from about 60% to about 80%, alternatively combinations thereof and any whole percentages or ranges of whole percentages within any of the aforementioned ranges, of PEG by weight of the precursor material 20, and thereby the particles 90.

Depending on the application, the precursor material 20, and thereby the particles 90, can comprise from about 0.5% to about 5% by weight of the particles of a balancing agent selected from the group consisting of glycerin, polypropylene glycol, isopropyl myristate, dipropylene glycol, 1,2-propanediol, and PEG having a weight average molecular weight less than 2,000, and mixtures thereof.

The precursor material 20, and thereby the particles 90, can comprise an antioxidant. The antioxidant can help to promote stability of the color and or odor of the particles over time between production and use. The precursor material 20, and thereby particles 90, can comprise between about 0.01% to about 1% by weight antioxidant. The precursor material 20, and thereby particles 90, can comprise between about 0.001% to about 2% by weight antioxidant. The precursor material 20, and thereby particles 90, can comprise between about 0.01% to about 0.1% by weight antioxidant. The antioxidant can be butylated hydroxytoluene.

Shading Dye

The precursor material 20 and particles 90 may comprise a shading dye. Preferably, at least about 0.0001%, 0.01%, 0.1%, 1%, 10%, 30%, 50%, 70%, 90%, or even about 95% of the particles 90 comprises shading dye.

The shading dye (sometimes referred to as hueing, bluing or whitening agents) typically provides a blue or violet shade to fabric. Shading dyes can be used either alone or in combination to create a specific shade of hueing and/or to shade different fabric types. This may be provided for example by mixing a red and green-blue dye to yield a blue or violet shade. Preferably the hueing dye is a blue or violet hueing dye, providing a blue or violet color to a white cloth or fabric. Such a white cloth treated with the composition will have a hue angle of 210 to 345, more preferably 240 to 345, more preferably 260 to 325, even more preferably 270 to 310.

In one aspect, a hueing dye suitable for use in the present invention has, in the wavelength range of about 400 nm to about 750 nm, in methanol solution, a maximum extinction coefficient greater than about 1000 liter/mol/cm. In one aspect, a hueing dye suitable for use in the present invention has, in the wavelength range of about 540 nm to about 630 nm, a maximum extinction coefficient from about 10,000 to about 100,000 liter/mol/cm. In one aspect, a hueing dye suitable for use in the present invention has, in the wavelength range of about 560 nm to about 610 nm, a maximum extinction coefficient from about 20,000 to about 70,000 liter/mol/cm or even about 90,000 liter/mol/cm.

The Test Methods provided below can be used to determine if a dye, or a mixture of dyes, is a shading dye for the purposes of the present invention.

Test Methods

I. Method for Determining Deposition for a Dye a.) Unbrightened Multifiber Fabric Style 41 swatches (MFF41, 5 cm×10 cm, average weight 1.46 g) serged with unbrightened thread are purchased from Testfabrics, Inc. (West Pittston, Pa.). MFF41 swatches are stripped prior to use by washing two full cycles in AATCC heavy duty liquid laundry detergent (HDL) nil brightener at 49° C. and washing 3 additional full cycles at 49° C. without detergent. Four replicate swatches are placed into each flask.

b.) A sufficient volume of AATCC standard nil brightener HDL detergent solution is prepared by dissolving the detergent in 0 gpg water at room temperature at a concentration of 1.55 g per liter.

c.) A concentrated stock solution of dye is prepared in an appropriate solvent selected from dimethyl sulfoxide (DMSO), ethanol or 50:50 ethanol:water. Ethanol is preferred. The dye stock is added to a beaker containing 400 mL detergent solution (prepared in step I.b. above) in an amount sufficient to produce an aqueous solution absorbance at the $\lambda_{max}$ of 0.1 AU (+0.01 AU) in a cuvette of path length 1.0 cm. For a mixture of dyes, the dyes are to be tested in the same relative proportions as found in the packaged composition comprising a plurality of particles, and the sum of the aqueous solution absorbance at the $\lambda_{max}$ of the individual dyes is 0.1 AU (+0.01 AU) in a cuvette of path length 1.0 cm. Total organic solvent concentration in a wash solution from the concentrated stock solution is less than 0.5%. A 125 mL aliquot of the wash solution is placed into 3 separate disposable 250 mL Erlenmeyer flasks (Thermo Fisher Scientific, Rochester, N.Y.).

d.) Four MFF41 swatches are placed into each flask, flasks are capped and manually shaken to wet the swatches. Flasks are placed onto a Model 75 wrist action shaker from Burrell Scientific, Inc. (Pittsburgh, Pa.) and agitated on the highest setting of 10 (390 oscillations per minute with an arc of 14.6°). After 12 minutes, the wash solution is removed by vacuum aspiration, 125 mL of Ogpg water is added for a rinse, and the flasks agitated for 4 additional minutes. Rinse solution is removed by vacuum aspiration and swatches are spun in a Mini Countertop Spin Dryer (The Laundry Alternative Inc., Nashua, N.H.) for 5 minutes, after which they are allowed to air dry in the dark.

e.) L*, a*, and b* values for the 3 most consumer relevant fabric types, cotton and polyester, are measured on the dry swatches using a LabScan XE reflectance spectrophotometer (HunterLabs, Reston, Va.; D65 illumination, 10° observer, UV light excluded). The L*, a*, and b* values of the 12 swatches (3 flasks each containing 4 swatches) are averaged and the hueing deposition (HD) of the dye is calculated for each fabric type using the following equation:

$$HD=DE^*=((L^*_c-L^*_s)^2+(a^*_c-a^*_s)^2+(b^*_c-b^*_s)^2)^{1/2}$$

wherein the subscripts c and s respectively refer to the control, i.e., the fabric washed in detergent with no dye, and the fabric washed in detergent containing dye, or a mixture of dyes, according to the method described above.

II. Method for Determining Relative Hue Angle (Vs. Nil Dye Control)

a) The a* and b* values of the 12 swatches from each solution are averaged and the following formulas are used to determine Δa* and Δb*:

$$\Delta a^*=a^*_c-a^*_s \text{ and } \Delta b^*=b^*_c-b^*_s$$

wherein the subscripts c and s respectively refer to the fabric washed in detergent with no dye and the fabric washed in detergent containing dye, or mixture of dyes, according to the method described in I. above.

b.) If the absolute value of both Δa* and Δb*<0.25, no Relative Hue Angle (RHA) is calculated. If the absolute value of either Δa* or Δb* are ≥0.25, the RHA is determined using one of the following formulas:

$$\text{When } \Delta b^*\geq 0,\ RHA=ATAN2(\Delta a^*,\Delta b^*)$$

$$\text{When } \Delta b^*<0,\ RHA=360+ATAN2(\Delta a^*,\Delta b^*)$$

III. Method to Determine if a Dye is a Shading Dye A dye, or mixture of dyes, is considered a shading dye (also known as a hueing dye) for the purposes of the present invention if (a) either the $HD_{cotton}$ or the $HD_{polyester}$ is greater than or equal to 2.0 DE* units or preferably greater than or equal to 3.0, or 4.0 or even 5.0, according to the formula above, and (b) the relative hue angle (see Method III. below) on the fabric that meets the DE* criterion in (a) is within 210 to 345, more preferably 240 to 345, more preferably 260 to 325, even more preferably 270 to 310. If the value of HD for both fabric types is less than 2.0 DE* units, or if the relative hue angle is not within the prescribed range on each fabric for which the DE* meets the criteria the dye is not a shading dye for the purposes of the present invention.

The shading dye may be selected from any chemical class of dye as known in the art, including but not limited to acridine, anthraquinone (including polycyclic quinones), azine, azo (e.g., monoazo, disazo, trisazo, tetrakisazo, polyazo), benzodifurane, benzodifuranone, carotenoid, coumarin, cyanine, diazahemicyanine, diphenylmethane, formazan, hemicyanine, indigoids, methane, naphthalimides, naphthoquinone, nitro, nitroso, oxazine, phthalocyanine, pyrazoles, stilbene, styryl, triarylmethane, triphenylmethane, xanthenes and mixtures thereof.

Suitable shading dyes include small molecule dyes, polymeric dyes and dye-clay conjugates. Preferred shading dyes are selected from small molecule dyes and polymeric dyes. As will be appreciated, any of the shading dyes as known in the art for use in detergent compositions may be suitable for incorporation into the precursor material 20 and particles 90.

Small Molecule Dyes

Suitable small molecule dyes may be selected from the group consisting of dyes falling into the Colour Index (C.I., Society of Dyers and Colourists, Bradford, UK) classifications of Acid, Direct, Basic, Reactive, Solvent or Disperse dyes. Preferably such dyes can be classified as Blue, Violet, Red, Green or Black, and provide the desired shade either alone or in combination with other dyes or in combination with other adjunct ingredients. Reactive dyes may contain small amounts of hydrolyzed dye as sourced, and in detergent formulations or in the wash may undergo additional hydrolysis. Such hydrolyzed dyes and mixtures may also serve as suitable small molecule dyes.

In another aspect, suitable dyes include those selected from the group consisting of dyes denoted by the Colour Index designations such as Direct Violet 5, 7, 9, 11, 31, 35, 48, 51, 66, and 99, Direct Blue 1, 71, 80 and 279, Acid Red 17, 73, 52, 88 and 150, Acid Violet 15, 17, 24, 43, 49 and 50, Acid Blue 15, 17, 25, 29, 40, 45, 48, 75, 80, 83, 90 and 113, Acid Black 1, Basic Violet 1, 3, 4, 10 and 35, Basic Blue 3, 16, 22, 47, 66, 75 and 159, anthraquinone Disperse or Solvent dyes such as Solvent Violet 11, 13, 14, 15, 15, 26, 28, 29, 30, 31, 32, 33, 34, 26, 37, 38, 40, 41, 42, 45, 48, 59; Solvent Blue 11, 12, 13, 14, 15, 17, 18, 19, 20, 21, 22, 35, 36, 40, 41, 45, 59, 59:1, 63, 65, 68, 69, 78, 90; Disperse Violet 1, 4, 8, 11, 11:1, 14, 15, 17, 22, 26, 27, 28, 29, 34, 35, 36, 38, 41, 44, 46, 47, 51, 56, 57, 59, 60, 61, 62, 64, 65, 67, 68, 70, 71, 72, 78, 79, 81, 83, 84, 85, 87, 89, 105; Disperse Blue 2, 3, 3:2, 8, 9, 13, 13:1, 14, 16, 17, 18, 19, 22, 23, 24, 26, 27, 28, 31, 32, 34, 35, 40, 45, 52, 53, 54, 55, 56, 60, 61, 62, 64, 65, 68, 70, 72, 73, 76, 77, 80, 81, 83, 84, 86, 87, 89, 91, 93, 95, 97, 98, 103, 104, 105, 107, 108, 109, 11, 112, 113, 114, 115, 116, 117, 118, 119, 123, 126, 127, 131, 132, 134, 136, 140, 141, 144, 145, 147, 150, 151, 152, 153, 154, 155, 156, 158, 159, 160, 161, 162, 163, 164, 166, 167, 168, 169, 170, 176, 179, 180, 180:1, 181, 182, 184, 185, 190, 191, 192, 196, 197, 198, 199, 203, 204, 213, 214, 215, 216, 217, 218, 223, 226, 227, 228, 229, 230, 231, 232, 234, 235, 236, 237, 238, 239, 240, 241, 242, 243, 244, 245, 246, 247, 249, 252, 261, 262, 263, 271, 272, 273, 274, 275, 276, 277, 289, 282, 288, 289, 292, 293, 296, 297, 298, 299, 300, 302, 306, 307, 308, 309, 310, 311, 312, 314, 318, 320, 323, 325, 326, 327, 331, 332, 334, 347, 350, 359, 361, 363, 372, 377 and 379, azo Disperse dyes such as Disperse Blue 10, 11, 12, 21, 30, 33, 36, 38, 42, 43, 44, 47, 79, 79:1, 79:2, 79:3, 82, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 206, 207, 209, 210, 211, 212, 219, 220, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 304, 313, 315, 316, 317:319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 3, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 104, 106 and 107. Preferably, small molecule dyes can be selected from the group consisting of C. I. numbers Acid Violet 17, Acid Blue 80, Acid Violet 50, Direct Blue 71, Direct Violet 51, Direct Blue 1, Acid Red 88, Acid Red 150, Acid Blue 29, Acid Blue 113 or mixtures thereof.

In another aspect suitable small molecule dyes include dyes with CAS-No's 52583-54-7, 42783-06-2, 210758-04-6, 104366-25-8, 122063-39-2, 167940-11-6, 52239-04-0, 105076-77-5,84425-43-4, and 87606-56-2, and non-azo dyes Disperse Blue 250, 354, 364, Solvent Violet 8, Solvent blue 43, 57, Lumogen F Blau 650, and Lumogen F Violet 570.

In another aspect suitable small molecule dyes include azo dyes, preferably mono-azo dyes, covalently bound to phthalocyanine moieties, preferably Al- and Si-phthalocyanine moieties, via an organic linking moiety.

Polymeric Dyes

Suitable polymeric dyes include dyes selected from the group consisting of polymers containing covalently bound (sometimes referred to as conjugated) chromogens, (also known as dye-polymer conjugates), for example polymers with chromogen monomers co-polymerized into the backbone of the polymer, polymers with pendant chromagen monomers, and mixtures thereof.

Polymeric dyes include: (a) Reactive dyes bound to water soluble polyester polymers via at least one and preferably two free OH groups on the water soluble polyester polymer. The water soluble polyester polymers can be comprised of comonomers of a phenyl dicarboxylate, an oxyalkyleneoxy and a polyoxyalkyleneoxy; (b) Reactive dyes bound to polyamines which are polyalkylamines that are generally linear or branched. The amines in the polymer may be primary, secondary and/or tertiary. Polyethyleneimine in one aspect is preferred. In another aspect, the polyamines are ethoxylated; (c) Dye polymers having dye moieties carrying negatively charged groups obtainable by copolymerization of an alkene bound to a dye containing an anionic group and one or more further alkene comonomers not bound to a dye moiety; (d) Dye polymers having dye moieties carrying positively charged groups obtainable by copolymerization of an alkene bound to a dye containing an cationic group and one or more further alkene comonomers not bound to a dye moiety; (e) Polymeric thiophene azo polyoxyalkylene dyes containing carboxylate groups; and (f) dye polymer conjugates comprising at least one reactive dye and a polymer comprising a moiety selected from the group consisting of a hydroxyl moiety, a primary amine moiety, a secondary amine moiety, a thiol moiety and combinations thereof; said polymers preferably selected from the group consisting of polysaccharides, proteins, polyalkyleneimines, polyamides, polyols, and silicones. In one aspect, carboxymethyl cellulose (CMC) may be covalently bound to one or more reactive blue, reactive violet or reactive red dye such as CMC conjugated with C.I. Reactive Blue 19, sold by Megazyme, Wicklow, Ireland under the product name AZO-CM-CELLULOSE, product code S-ACMC.

Other suitable polymeric dyes include polymeric dyes selected from the group consisting of alkoxylated triphenylmethane polymeric colorants, alkoxylated carbocyclic and alkoxylated heterocyclic azo colorants, including alkoxylated thiophene polymeric colorants, and mixtures thereof. Preferred polymeric dyes comprise the optionally substituted alkoxylated dyes, such as alkoxylated triphenyl-methane polymeric colorants, alkoxylated carbocyclic and alkoxylated heterocyclic azo colorants including alkoxylated thiophene polymeric colorants, and mixtures thereof, such as the fabric-substantive colorants sold under the name of Liquitint® (Milliken, Spartanburg, S.C., USA).

Suitable polymeric dyes are illustrated below. As with all such alkoxylated compounds, the organic synthesis may produce a mixture of molecules having different degrees of alkoxylation. During a typical ethoxylation process, for example, the randomness of the ethylene oxide addition results in a mixture of oligomers with different degrees of ethoxylation. As a consequence of its ethylene oxide number distribution, which often follows a Poisson law, a commercial material contains substances with somewhat different properties. For example, in one aspect, the polymeric dye resulting from an ethoxylation is not a single compound containing five ($CH_2CH_2O$) units as the general structure (Formula A, with x+y=5) may suggest. Instead, the product is a mixture of several homologs whose total of ethylene oxide units varies from about 2 to about 10. Industrially relevant processes will typically result in such mixtures, which may normally be used directly to provide the shading dye, or less commonly may undergo a purification step.

Preferably, the shading dye may have the following structure:

$$\text{Dye-}(G)_a\text{-}NR^1R^2,$$

wherein the $-(G)_a-NR^1R^2$ group is attached to an aromatic ring of the dye, G is independently —$SO_2$— or —C(O)—, the index a is an integer with a value of 0 or 1 and $R^1$ and $R^2$ are independently selected from H, a polyoxyalkylene chain, a $C_{1-8}$ alkyl, optionally the alkyl chains comprise ether (C—O—C), ester and/or amide links, optionally the alkyl chains are substituted with —Cl, —Br, —CN, —$NO_2$, —$SO_2CH_3$, —OH and mixtures thereof, $C_{6-10}$ aryl, optionally substituted with a polyoxyalkylene chain, $C_{7-16}$ alkaryl optionally substituted with ether (C—O—C), ester and/or amide links, optionally substituted with —Cl, —Br, —CN, —$NO_2$, —$SO_2CH_3$, —OH, polyoxyalkylene chain substituted $C_{1-8}$ alkyl, polyoxyalkylene chain substituted $C_{6-10}$ aryl, polyoxyalkylene chain substituted $C_{7-16}$ alkaryl and mixtures thereof; said polyoxyalkylene chains independently having from about 2 to about 100, about 2 to about 50, about 3 to about 30 or about 4 to about 20 repeating units. Preferably, the repeating units are selected from the group consisting of ethylene oxide, propylene oxide, butylene oxide and mixtures thereof. Preferably, the repeating units are essentially ethylene oxide.

Preferably, the shading dye may have the structure of Formula A:

Formula A

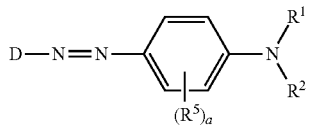

wherein each $R^5$ is independently selected from the group consisting of alkyl, oxyalkyl, oxyaryl, sulfonamidoalkyl, sulfonamidoaryl, amidoalkyl, amidodialkyl, amidoaryl, amidodiaryl, halogen, thioalkyl and thioaryl;

wherein the index a is an integer from about 0 to about 4;

wherein D is an aromatic or heteroaromatic group;

wherein $R^1$ and $R^2$ are independently selected from the group consisting of:

(a) $R^1$ and $R^2$=$[(CH_2CR'HO)_x(CH_2CR''HO)_yH]$ wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein said x $(CH_2CR'HO)$ groups and said y $(CH_2CR''HO)$ groups may be arranged in any order; wherein $x+y\leq 10$; wherein $y\geq 1$; and wherein independently each z=0 to 5;

(b) $R^1$=H, alkyl, aryl or aryl alkyl and $R^2$=$[(CH_2CR'HO)_x(CH_2CR''HO)_yH]$ wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein said $(CH_2CR'HO)_x$ groups and said $(CH_2CR''HO)_y$ groups may be arranged in any order; wherein $x+y\leq 20$; wherein $y\geq 1$; and wherein z=0 to 5;

(c) $R^1$=$[CH_2CH(OR^3)CH_2OR^4]$ and $R^2$=$[CH_2CH(OR^3)CH_2OR^4]$ wherein $R^3$ is selected from the group consisting of H, $(CH_2CH_2O)_zH$, and mixtures thereof; and wherein z=0 to 10;

wherein $R^4$ is selected from the group consisting of $(C_1$-$C_{16})$alkyl, aryl groups, and mixtures thereof; and (d) $R^1$ and $R^2$ can independently be selected from the amino addition product of styrene oxide, glycidyl methyl ether, isobutyl glycidyl ether, isopropylglycidyl ether, t-butyl glycidyl ether, 2-ethylhexylgycidyl ether, and glycidylhexadecyl ether, followed by the addition of from 1 to 10 alkylene oxide units.

Preferably, the fabric shading dye may have the general structure below:

A

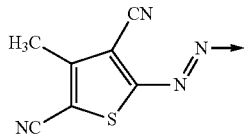

B

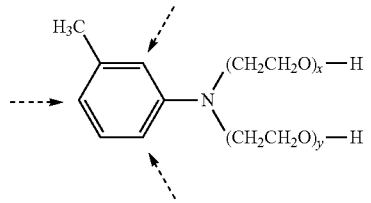

wherein moiety A shown above is attached via the distal nitrogen atom to one of the three sites on the aromatic ring of moiety B indicated by the dashed arrows shown above; preferably said A moiety is attached at the position on the aryl ring para to the N substituent on moiety B, however the A moiety may be attached at either of the other two indicated positions that are located ortho to the N substituent on moiety B; wherein the index values x and y are independently selected from 1 to 10. In some aspects, the average degree of ethoxylation, x+y, sometimes also referred to as the average number of ethoxylate groups, is from about 3 to about 12, preferably from about 4 to about 8. In some embodiments the average degree of ethoxylation, x+y, can be from about 5 to about 6. The range of ethoxylation present in the mixture varies depending on the average number of ethoxylates incorporated. Typical distributions for ethoxylation of toluidine with either 5 or 8 ethoxylates are shown in Table II on page 42 in the Journal of Chromatography A 1989, volume 462, pp. 39-47. The whitening agents are synthesized according to the procedures disclosed in U.S. Pat. No. 4,912,203 to Kluger et al.; a primary aromatic amine is reacted with an appropriate amount of ethylene oxide, according to procedures well known in the art. The polyethyleneoxy substituted m-toluidine useful in the preparation of the colorant can be prepared by a number of well known methods. It is preferred, however, that the polyethyleneoxy groups be introduced into the m-toluidine molecule by reaction of the m-toluidine with ethylene oxide. Generally the reaction proceeds in two steps, the first being the formation of the corresponding N,N-dihydroxyethyl substituted m-toluidine. In some aspects, no catalyst is utilized in this first step (for example as disclosed at Column 4, lines 16-25 of U.S. Pat. No. 3,927,044 to Foster et al.). The dihydroxyethyl substituted m-toluidine is then reacted with additional ethylene oxide in the presence of a catalyst such as sodium (described in Preparation II of U.S. Pat. No. 3,157,633 to Kuhn), or it may be reacted with additional ethylene oxide in the presence of sodium or potassium hydroxide (described in Example 5 of U.S. Pat. No. 5,071,440 to Hines et al.). The amount of ethylene oxide added to the reaction mixture determines the number of ethyleneoxy groups which ultimately attach to the nitrogen atom. In some aspects, an excess of the polyethyleneoxy substituted m-toluidine coupler may be employed in the formation of the whitening agent and remain as a component in the final colorant mixture. In certain aspects, the presence of excess coupler may confer advantageous properties to a mixture in which it is incorporated such as the raw material, a pre-mix, a finished product or even the wash solution prepared from the finished product.

The shading dye may preferably have the following structure:

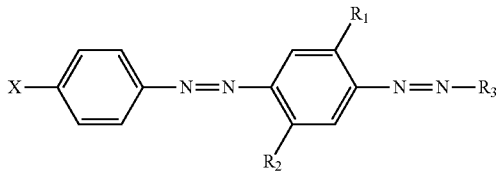

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain.

The hueing dye may be a thiophene dye such as a thiophene azo dye, preferably alkoxylated. Optionally the dye may be substituted with at least one solubilising group selected from sulphonic, carboxylic or quaternary ammonium groups.

Non-limiting examples of suitable shading dyes are:
Dye Formula 1
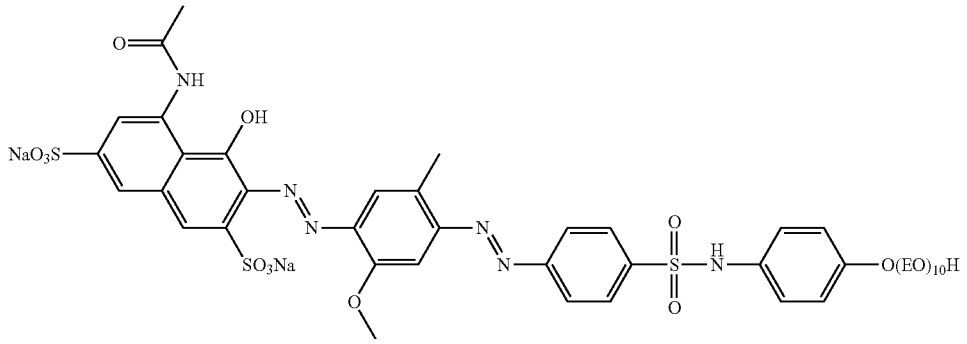
Dye Formula 2
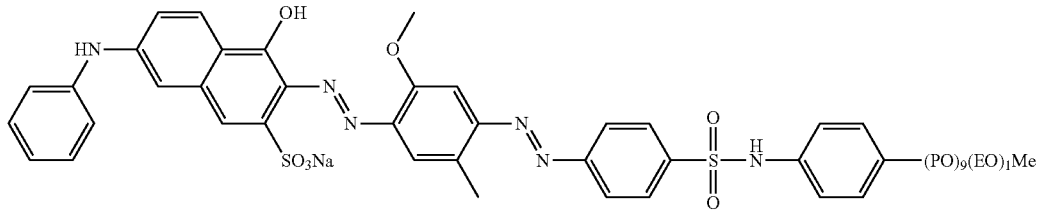
Dye Formula 3
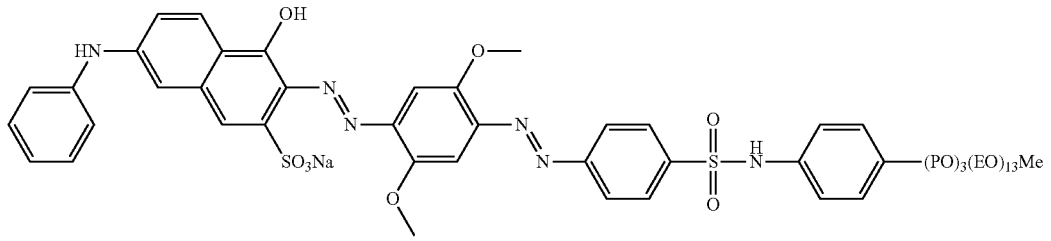
Dye Formula 4
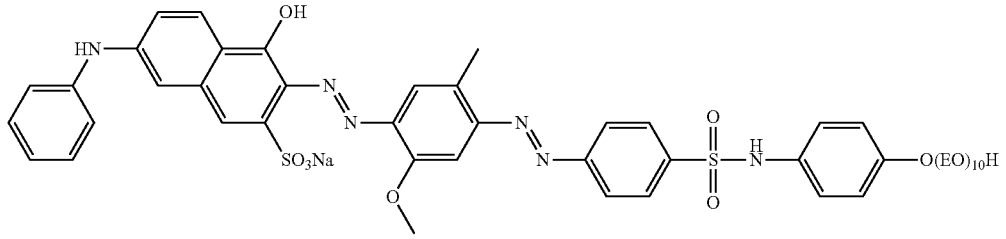
Dye Formula 5
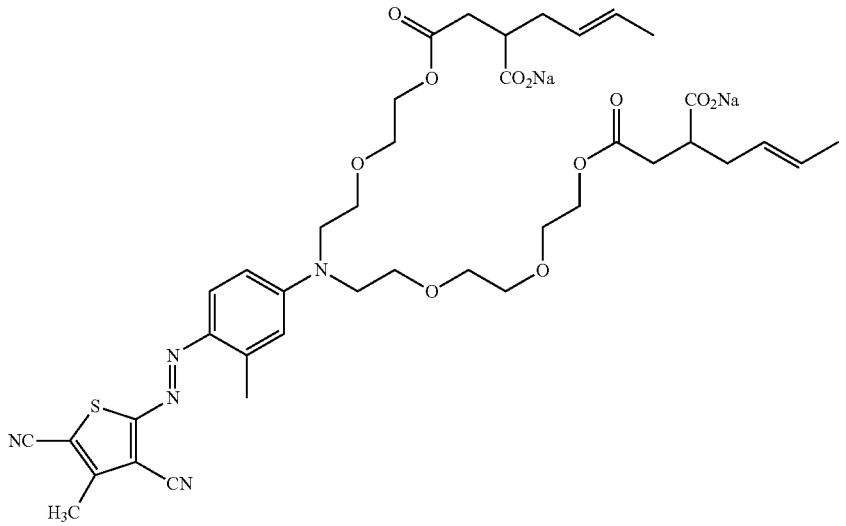

-continued
Dye Formula 6
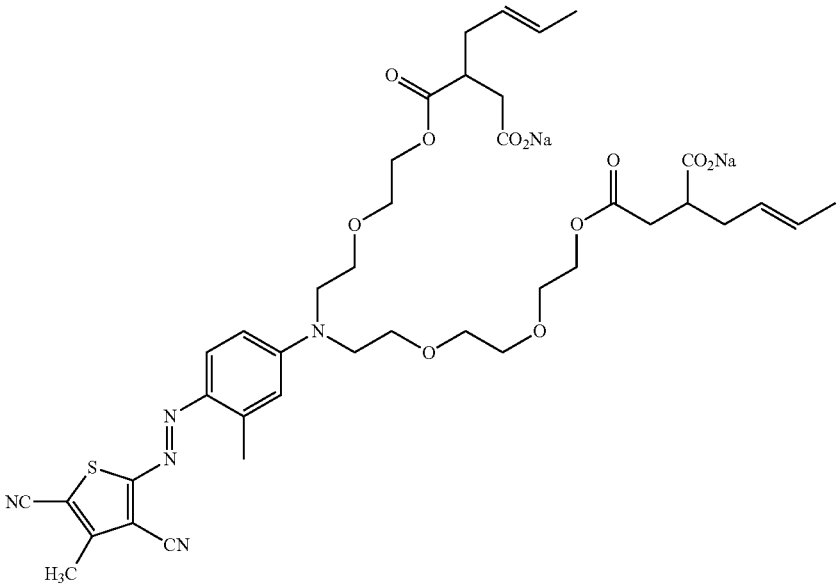
Dye Formula 7
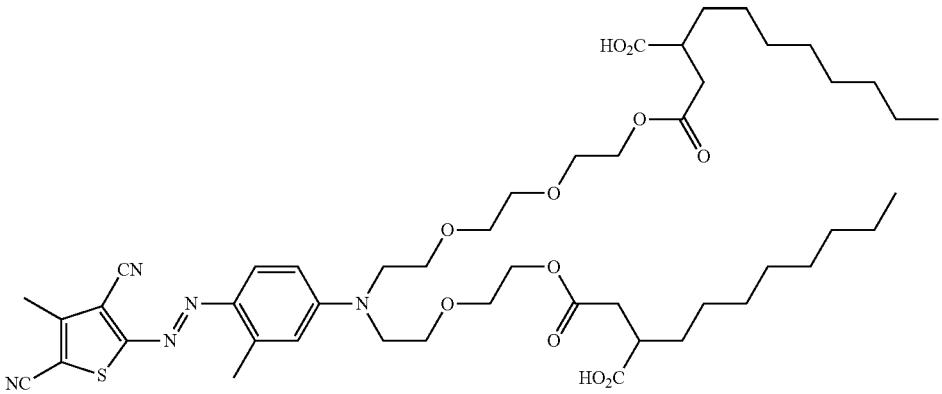
Dye Formula 8
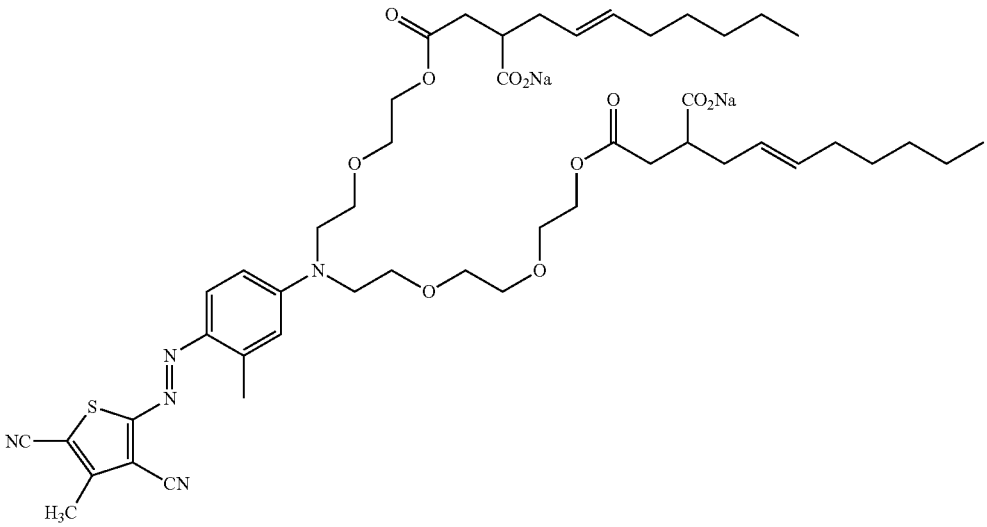

-continued

Dye Formula 9

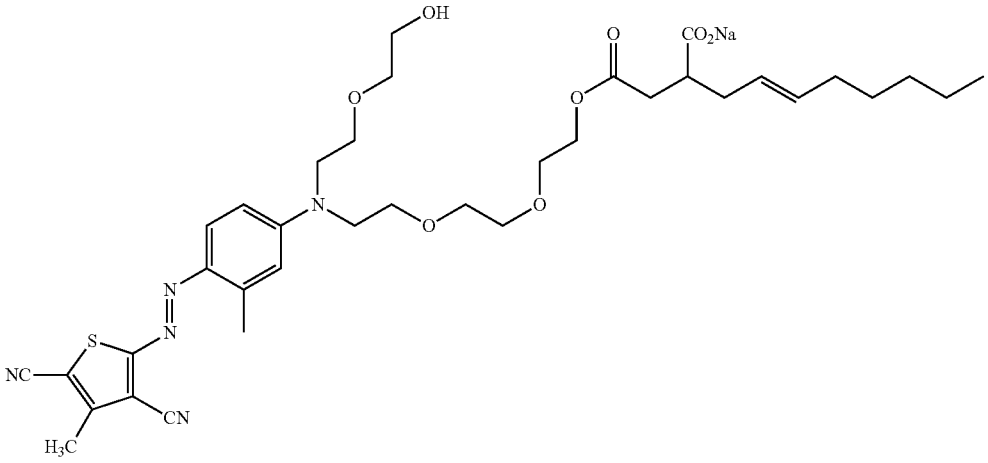

Dye Formula 10

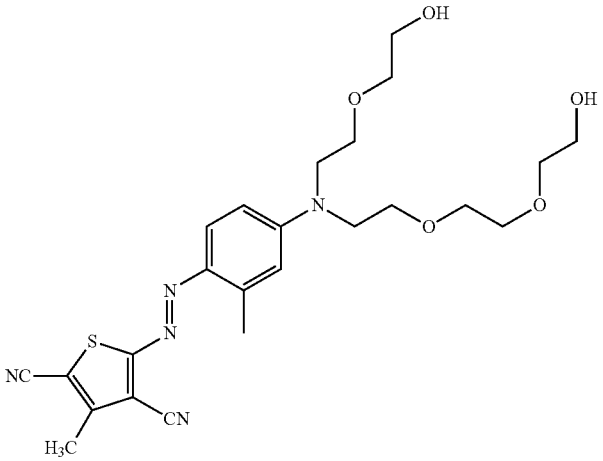

Dye-Clay Conjugates

Suitable dye clay conjugates include dye clay conjugates selected from the group comprising at least one cationic/basic dye and a smectite clay; a preferred clay may be selected from the group consisting of Montmorillonite clay, Hectorite clay, Saponite clay and mixtures thereof. In another aspect, suitable dye clay conjugates include dye clay conjugates selected from the group consisting of a clay and one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11 In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Perfume

In addition to the PEG and shading dye in the precursor material 20, and thereby the particles 90, the precursor material 20, and thereby the particles 90, can further comprise 0.1% to about 20% by weight perfume. Alternatively, the particles 90, the precursor material 20, and thereby the particles 90, can be substantially free or free of perfume. The perfume can be unencapsulated perfume, encapsulated perfume, perfume provided by a perfume delivery technology, or a perfume provided in some other manner. Perfumes are generally described in U.S. Pat. No. 7,186,680 at column 10, line 56, to column 25, line 22. The precursor material 20, and thereby particles 90, can comprise unencapsulated perfume and are essentially free of perfume carriers, such as a perfume microcapsules. The precursor material 20, and there by particles 90, can comprise perfume carrier materials (and perfume contained therein). Examples of perfume carrier materials are described in U.S. Pat. No. 7,186,680, column 25, line 23, to column 31, line 7. Specific examples of perfume carrier materials may include cyclodextrin and zeolites.

The precursor material 20, and thereby particles 90, can comprise about 0.1% to about 20%, alternatively about 1% to about 15%, alternatively 2% to about 10%, alternatively combinations thereof and any whole percentages within any of the aforementioned ranges, of perfume by weight of the precursor material 20 or particles 90. The precursor material 20, and thereby particles 90, can comprise from about 0.1% by weight to about 6% by weight of the precursor material 20 or particles 90 of perfume. The perfume can be unencapsulated perfume and or encapsulated perfume.

The precursor material 20, and thereby particles 90, can be free or substantially free of a perfume carrier. The precursor material 20, and thereby particles 90, may comprise about 0.1% to about 20%, alternatively about 1% to about 15%, alternatively 2% to about 10%, alternatively combinations thereof and any whole percentages within any of the aforementioned ranges, of unencapsulated perfume by weight of the precursor material 20, and thereby particles 90.

The precursor material 20, and thereby particles 90, can comprise unencapsulated perfume and perfume microcapsules. The precursor material 20, and thereby particles 90, may comprise about 0.1% to about 20%, alternatively about 1% to about 15%, alternatively from about 2% to about 10%, alternatively combinations thereof and any whole percentages or ranges of whole percentages within any of the aforementioned ranges, of the unencapsulated perfume by weight of the precursor material 20, and thereby particles 90. Such levels of unencapsulated perfume can be appropriate for any of the precursor materials 20, and thereby particles 90, disclosed herein that have unencapsulated perfume.

The precursor material 20, and thereby particles 90, can comprise unencapsulated perfume and a perfume microcapsule but be free or essentially free of other perfume carriers. The precursor material 20, and thereby particles 90, can comprise unencapsulated perfume and perfume microcapsules and be free of other perfume carriers.

The precursor material 20, and thereby particles 90, can comprise encapsulated perfume. Encapsulated perfume can be provided as plurality of perfume microcapsules. A perfume microcapsule is perfume oil enclosed within a shell. The shell can have an average shell thickness less than the maximum dimension of the perfume core. The perfume microcapsules can be friable perfume microcapsules. The perfume microcapsules can be moisture activated perfume microcapsules.

The perfume microcapsules can comprise a melamine/formaldehyde shell. Perfume microcapsules may be obtained from Appleton, Quest International, or International Flavor & Fragrances, or other suitable source. The perfume microcapsule shell can be coated with polymer to enhance the ability of the perfume microcapsule to adhere to fabric. This can be desirable if the particles 90 are designed to be a fabric treatment composition. The perfume microcapsules can be those described in U.S. Patent Pub. 2008/0305982.

The precursor material 20, and thereby particles 90, can comprise about 0.1% to about 20%, alternatively about 1% to about 15%, alternatively 2% to about 10%, alternatively combinations thereof and any whole percentages within any of the aforementioned ranges, of encapsulated perfume by weight of the precursor material 20, or particles 90.

The precursor material 20, and thereby particles 90, can comprise perfume microcapsules but be free of or essentially free of unencapsulated perfume. The precursor material 20, and thereby particles 90, may comprise about 0.1% to about 20%, alternatively about 1% to about 15%, alternatively about 2% to about 10%, alternatively combinations thereof and any whole percentages within any of the aforementioned ranges, of encapsulated perfume by weight of the precursor material 20 or particles 90.

The precursor material 20 can be prepared by providing molten PEG into a batch mixer 10. The batch mixer 10 can be heated so as to help prepare the precursor material 20 at the desired temperature. Shading dye and perfume, if present, may be added to the molten PEG. Aesthetic dye, if present, can also be added to the batch mixer 10. Other adjunct materials can be added to the precursor material 20 if desired. The precursor material 20 can optionally be prepared by in-line mixing or other known approaches for mixing materials.

If an aesthetic dye is employed, the precursor material 20 and particles 90 may comprise aesthetic dye. The precursor material 20, and thereby particles 90, may comprise less than about 0.1%, alternatively about 0.001% to about 0.1%, alternatively about 0.01% to about 0.02%, alternatively combinations thereof and any hundredths of percent or ranges of hundredths of percent within any of the aforementioned ranges, of aesthetic dye by weight of the precursor material 20 or particles 90. Examples of suitable aesthetic dyes include, but are not limited to, LIQUITINT PINK AM, AQUA AS, CYAN 15, and VIOLET FL, available from Milliken Chemical.

The particles 90 may have a variety of shapes. The particles 90 may be formed into different shapes include tablets, pills, spheres, and the like. A particle 90 can have a shape selected from the group consisting of spherical, hemispherical, compressed hemispherical, lentil shaped, and oblong. Lentil shaped refers to the shape of a lentil bean. Compressed hemispherical refers to a shape corresponding to a hemisphere that is at least partially flattened such that the curvature of the curved surface is less, on average, than the curvature of a hemisphere having the same radius. A compressed hemispherical particle 90 can have a ratio of height to maximum based dimension of from about 0.01 to about 0.4, alternatively from about 0.1 to about 0.4, alternatively from about 0.2 to about 0.3. Oblong shaped refers to a shape having a maximum dimension and a maximum secondary dimension orthogonal to the maximum dimension, wherein the ratio of maximum dimension to the maximum secondary dimension is greater than about 1.2. An oblong shape can have a ratio of maximum base dimension to maximum secondary base dimension greater than about 1.5. An oblong shape can have a ratio of maximum base dimension to maximum secondary base dimension greater than about 2. Oblong shaped particles can have a maximum base dimension from about 2 mm to about 6 mm, a maximum secondary base dimension of from about 2 mm to about 6 mm.

Individual particles 90 can have a mass from about 0.1 mg to about 5 g, alternatively from about 10 mg to about 1 g, alternatively from about 10 mg to about 500 mg, alternatively from about 10 mg to about 250 mg, alternatively from about 0.95 mg to about 125 mg, alternatively combinations thereof and any whole numbers or ranges of whole numbers of mg within any of the aforementioned ranges. In a plurality of particles 90, individual particles can have a shape selected from the group consisting of spherical, hemispherical, compressed hemispherical, lentil shaped, and oblong.

An individual particle may have a volume from about 0.003 $cm^3$ to about 0.15 $cm^3$. A number of particles 90 may collectively comprise a dose for dosing to a laundry washing machine or laundry wash basin. A single dose of particles 90 may comprise, per 3 kg of fabric being laundered, from about 0.1 g to about 200 g, or from about 0.5 g to about 100 g, or from about 2.0 g to about 60 g, or from about 5 g to about 25 g of particles. A single dose of the particles 90 may comprise from about 1 g to about 27 g. A single dose of the particles 90 may comprise from about 5 g to about 27 g, alternatively from about 13 g to about 27 g, alternatively from about 14 g to about 20 g, alternatively from about 15 g to about 19 g, alternatively from about 18 g to about 19 g, alternatively combinations thereof and any whole numbers of grams or ranges of whole numbers of grams within any of the aforementioned ranges. The individual particles 90 forming the dose of particles 90 that can make up the dose can have a mass from about 0.95 mg to about 2 g. The plurality of particles 90 can be made up of particles having different size, shape, and/or mass. The particles 90 in a dose can have a maximum dimension less than about 1 centimeter.

Figure 4:
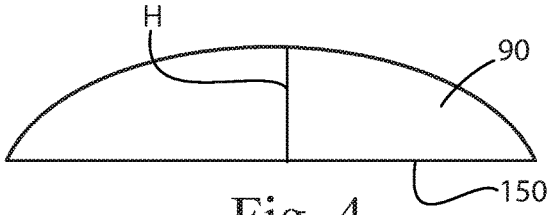
FIG. 4 is a profile view of a particle.

A particle 90 that can be manufactured as provided herein is shown in FIG. 4. FIG. 4 is a profile view of a single particle 90. The particle 90 can have a substantially flat base 150 and a height H. The height H of a particle 90 is measured as the maximum extent of the particle 90 in a direction orthogonal to the substantially flat base 150. The height H can be measured conveniently using image analysis software to analyze a profile view of the particle 90.

The process for forming particles 90 in which gas is entrained into the precursor material 20 thereby forming particles 90 have gas entrained therein can be practical for providing particles 90 that float in a liquid. Particles 90 that float in certain liquids can be practical in a variety of industrial processes and processes in the home in which particles can be used.

Particles 90 that have gas entrained therein are comprised of gas inclusions and solid and or liquid materials. Since the particles 90 in these embodiments have gas entrained therein, the particles 90 have a density that is less than the density of the constitutive solid and or liquid materials forming the particle 90. For instance if the particle 90 is formed of a constitutive material having a density of 1 g/cm$^3$, and the particle 90 is 10% by volume air, the density of the particle 90 is 0.90 g/cm$^3$.

Figure 5:
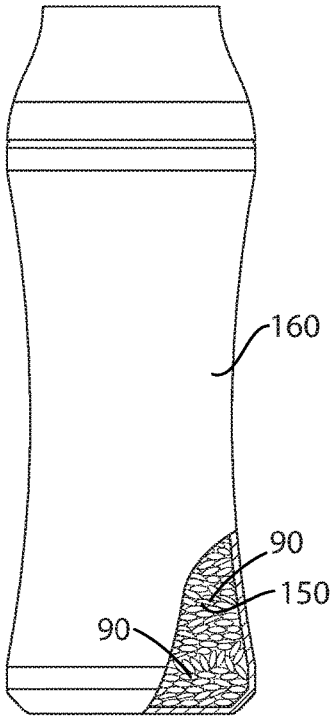
FIG. 5 is a packaged composition comprising a plurality of particles.

The particles 90 can be packaged together as a packaged composition 160 comprising a plurality of particles 90, as shown in FIG. 5. The particles can comprise a carrier, shading dye, perfume, and occlusions of gas. Without being bound by theory, spherical occlusions of gas are thought to provide for improved strength of the particles 90 as compared to particles 90 having occlusions of gas having other shapes. Spherical occlusions of gas might provide for improved strength over non-spherical occlusions of gas.

In embodiments that do not include occlusions of air, at least 80%, 90%, 95%, substantially all of the particles 90 can have a density greater than about 1 g/cm$^3$ and preferably less than about 1.25 g/cm$^3$. In embodiments that do include occlusions of air, at least 80%, 90%, 95%, substantially all of the particles 90 can have a density less than about 0.95 g/cm$^3$. Since the density of a typical washing solution is about 1 g/cm$^3$, it can be desirable to provide particles 90 that have a density greater than about 1 g/cm$^3$ or, in some embodiments, less than about 0.95 g/cm$^3$. Having nearly all of the particles 90 have a density greater than about 1 g/cm$^3$ can be desirable for providing for particles 90 that sink in a wash liquor. Having nearly all of the particles 90 have a density less than about 1 g/cm$^3$ can be desirable for providing for particles 90 that float in a wash liquor.

At least 80%, 90%, 95%, substantially all of the particles 90 can have a mass between about 0.1 mg to about 5 g. Particles 90 can have a maximum dimension of less than about 20 mm. Particles 90 can have a maximum dimension of less than about 10 mm. Particles 90 having such a mass and maximum dimension are thought to be readily dissolvable in solutions such a wash solutions used in laundering clothing.

Each of the particles 90 can have a volume and the occlusions of gas within the particles 90 can comprise between about 0.5% to about 50% by volume of the particle 90, or even between about 1% to about 20% by volume of the particle, or even between about 2% to about 15% by volume of the particle, or even between about 4% to about 12% by volume of the particle. Without being bound by theory, it is thought that if the volume of the occlusions of gas is too great, the particles 90 may not be sufficiently strong to be packaged, shipped, stored, and used without breaking apart in an undesirable manner.

The occlusions can have an effective diameter between about 1 micron to about 2000 microns, or even between about 5 microns to about 1000 microns, or even between about 5 microns to about 200 microns, or even between about 25 to about 50 microns. In general, it is thought that smaller occlusions of gas are more desirable than larger occlusions of gas. If the effective diameter of the occlusions of gas are too large, it is thought that the particles might not be sufficiently strong to be to be packaged, shipped, stored, and used without breaking apart in an undesirable manner. The effective diameter is diameter of a sphere having the same volume as the occlusion of gas. The occlusions of gas can be spherical occlusions of gas.

Particles 90 can be produced as follows. A 50 kg batch of precursor material 20 can be prepared in a mixer. Molten PEG8000 can be added to a jacketed mixer held at 70° C. and agitated with a pitch blade agitator at 125 rpm. Butylated hydroxytoluene can be added to the mixer at a level of 0.01% by weight of the precursor material 20. Dipropylene glycol can be added to the mixer at a level of 1.08% by weight of the precursor material 20. A water based slurry of perfume microcapsules can be added to the mixer at a level of 4.04% by weight of the precursor material 20. Unencapsulated perfume can be added to the mixer at a level of 7.50% by weight of the precursor material 20. Shading dye can be added to the mixer at a level of 0.0095% by weight of the precursor material 20. The PEG can account for 87.36% by weight of the precursor material 20. The precursor material 20 can be mixed for 30 minutes.

The precursor material 20 can be formed into particles 90 on a SANDVIK ROTOFORM 3000 having a 750 mm wide 10 m long belt. The cylinder 110 can have 2 mm diameter apertures 60 set at a 10 mm pitch in the cross machine direction CD and 9.35 mm pitch in the machine direction MD. The cylinder can be set at approximately 3 mm above the belt. The belt speed and rotational speed of the cylinder 110 can be set at 10 m/min.

After mixing the precursor material 20, the precursor material 20 can be pumped at a constant 3.1 kg/min rate from the mixer 10 through a plate and frame heat exchanger set to control the outlet temperature to 50° C.

Air or another gas can be entrained in the precursor material 20 at a level of about 0.5% to about 50% by volume. The precursor material 20 having air or another gas entrained therein can be passed through a Quadro Z1 mill with medium rotor/stator elements. After milling, the precursor material can optionally be passed through a Kenics 1.905 cm KMS 6 static mixer 50 installed 91.44 cm upstream of the stator 100.

Table 1 lists formulations for particles 90 that could be made.

TABLE 1

Potential formulations for particles.

| % Wt | F1 | F2 | F3 | F4 | F5 | F6 |
|---|---|---|---|---|---|---|
| PEG 8000 | 82.8 | 82.8 | 86.9 | 88.9 | 95.5 | 82.0 |
| BHT | 0.0135 | 0.0135 | 0.0173 | 0.0167 | 0-0.02 | 0.0213 |
| Perfume Microcapsule | 1.28 | 1.28 | 0.815 | 3.80 | 1.62 | — |
| Neat Perfume Oil | 6.65 | 6.65 | 5.80 | 3.84 | — | 8.58 |
| Dipropylene Glycol | 5.82 | 5.82 | 4.87 | 1.58 | — | 7.44 |
| Shading Dye | 0.0203 | 0.0203 | 0.0304 | 0.0288 | 0.0252 | 0.0355 |
| Water and Minors | Balance | Balance | Balance | Balance | Balance | Balance |
| % Air by Volume of Particle | 0-5% | 15 | 21.5 | 30.5 | 5.5 | 44.9 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaged composition comprising a plurality of particles, wherein at least one of said particles comprises:

a carrier; and a shading dye;

wherein at least 80% of said particles have a density less than about 1.25 g/cm$^3$;

wherein at least 80% of said particles have a mass between about 0.1 mg to about 5 g;

wherein each of said particles has a maximum dimension of less than about 10 mm;

wherein each of said particles comprise occlusions of gas having an effective diameter between about 5 microns to 500 microns;

wherein each of said particles has a volume and said occlusions of gas within said particle comprise between about 0.5% to about 50% by volume of said particle.

2. The packaged composition according to claim 1, wherein the shading dye is selected from the group consisting of acridines, anthraquinones, azines, azos, benzodifuranes, benzodifuranones, carotenoids, coumarins, cyanines, diazahemicyanines, diphenylmethanes, formazans, hemicyanines, indigoids, methanes, naphthalimides, naphthoquinones, nitros, nitrosos, oxazines, phthalocyanines, pyrazoles, stilbenes, styryls, triarylmethanes, triphenylmethanes, xanthenes and mixtures thereof.

3. The packaged composition according to claim 1, wherein the shading dye is selected from the group consisting of a small molecule anthraquinone dye, a small molecule azine dye, a small molecule azo dye, a polymeric anthraquinone dye, a polymeric azine dye, a polymeric azo dye, and mixtures thereof.

4. The packaged composition according to claim 1, wherein the shading dye has the following structure:

$$\text{Dye-(G)}a\text{-NR}^1\text{R}^2,$$

wherein the (G)a-$NR^1R^2$ group is attached to an aromatic ring of the dye, G is independently —$SO_2$— or —C(O)—, the index a is an integer with a value of 0 or 1, and $R^1$ and $R^2$ are independently selected from the group consisting of H, a polyoxyalkylene chain, $C_{1-8}$ alkyl, $C_{6-10}$ aryl, $C_{7-16}$ alkaryl, polyoxyalkylene chain substituted $C_{1-8}$ alkyl, polyoxyalkylene chain substituted $C_{6-10}$ aryl, polyoxyalkylene chain substituted $C_{7-16}$ alkaryl and mixtures thereof; said polyoxyalkylene chains independently having from about 2 to about 100 repeating units.

5. The packaged composition according to claim 4, wherein the shading dye is a polymeric dye and at least one of $R_1$ and $R_2$ comprises a polyalkyleneoxy chain.

6. The packaged composition according to claim 5, wherein the polyalkyleneoxy chain comprises from about 2 to about 50 repeating units, wherein the repeating units are essentially ethylene oxide.

7. The packaged composition according to claim 1, wherein said particles comprise perfume.

8. The packaged composition according to claim 1, wherein said particles are substantially free of perfume.

9. The packaged composition according to claim 1, wherein said carrier is selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid carboxymethyl cellulose, fatty acid, fatty alcohol, glyceryl diester of hydrogenated tallow, glycerol, polyethylene glycol, polyvinyl alcohol and combinations thereof.

10. The packaged composition according to claim 1, wherein said particles comprise from about 20% to about 99.9% by weight of said particles of said carrier.

11. The packaged composition according to claim 1, wherein said carrier is polyethylene glycol having a weight average molecular weight from about 2000 to about 13000.

12. The packaged composition according to claim 1, further comprising from about 0.001% to less than about 90% of a fabric care adjunct.

13. A process for treating laundry comprising the step of dosing to a laundry washing machine or a laundry wash basin containing laundry from about 5 g to about 60 g of the packaged composition according to claim 1.

14. The packaged composition according to claim 1, wherein said occlusions of gas have an effective diameter between about 5 microns to about 200 microns.

* * * * *